US009162440B2

(12) United States Patent
Schach

(10) Patent No.: US 9,162,440 B2
(45) Date of Patent: Oct. 20, 2015

(54) DEVICE FOR PROCESSING CONTAINERS

(75) Inventor: Martin Schach, Bochum (DE)

(73) Assignee: KHS GmbH, Dortmund (DE)

( * ) Notice: Subject to any disclaimer, the term of this patent is extended or adjusted under 35 U.S.C. 154(b) by 0 days.

(21) Appl. No.: 14/358,344

(22) PCT Filed: Sep. 13, 2012

(86) PCT No.: PCT/EP2012/003841

§ 371 (c)(1),
(2), (4) Date: May 15, 2014

(87) PCT Pub. No.: WO2013/075764

PCT Pub. Date: May 30, 2013

(65) Prior Publication Data

US 2014/0290515 A1 Oct. 2, 2014

(30) Foreign Application Priority Data

Nov. 23, 2011 (DE) ..... 10 2011 119 171

(51) Int. Cl.

| | |
|---|---|
| ***B41F 35/00*** | (2006.01) |
| ***B08B 15/00*** | (2006.01) |
| ***B08B 15/02*** | (2006.01) |
| ***B41J 3/407*** | (2006.01) |

(52) U.S. Cl.

CPC ..... *B41F 35/00* (2013.01); *B08B 15/007* (2013.01); *B08B 15/02* (2013.01); *B41J 3/4073* (2013.01)

(58) Field of Classification Search

CPC ..... B08B 15/02

USPC ..... 101/425

See application file for complete search history.

(56) References Cited

U.S. PATENT DOCUMENTS

| | | | | |
|---|---|---|---|---|
| 4,219,286 | A * | 8/1980 | Lindenthal | 403/338 |
| 4,964,196 | A * | 10/1990 | Schmid et al. | 19/200 |
| 5,009,161 | A * | 4/1991 | Wirz | 101/425 |
| 5,150,502 | A * | 9/1992 | Roberson | 19/105 |
| 5,386,097 | A * | 1/1995 | Ruckl | 219/121.68 |
| 5,540,152 | A * | 7/1996 | DeMoore | 101/483 |
| 2004/0149107 | A1 | 8/2004 | Lee | |
| 2007/0107252 | A1 * | 5/2007 | Kruckenhauser et al. | 34/402 |
| 2012/0175815 | A1 * | 7/2012 | Aebi et al. | 264/328.1 |

FOREIGN PATENT DOCUMENTS

| | | |
|---|---|---|
| CN | 101610733 | 12/2009 |
| DE | 2322219 | 11/1974 |
| DE | 44 39 081 | 5/1996 |
| DE | 10 2006 053 821 | 5/2008 |
| DE | 10 2008 013174 | 12/2009 |

(Continued)

*Primary Examiner* — Anthony Nguyen

(74) *Attorney, Agent, or Firm* — Occhiuti & Rohlicek LLP

(57) ABSTRACT

An extractor for placement adjacent to a rotor having processing positions in a circumferential area thereof extracts contaminants arising during container processing. The extractor has a hood forming an interior, an extractor channel, baffles, flow channels, and a joint suction channel. In operation, the hood, which does not move with the rotor, extends over part of the circumferential area. The hood's interior opens radially towards the rotor and is connected by the extractor channel to a suction device. The baffles, which are formed by wall elements in the hood interior, define the flow channels. The flow channels are open on a side of the hood that faces the rotor, and open inside the extractor hood into the joint suction channel.

20 Claims, 8 Drawing Sheets

(56) References Cited

FOREIGN PATENT DOCUMENTS

| | | |
|---|---|---|
| DE | 10 2009 013 477 | 9/2010 |
| DE | 10 2009 043 497 | 3/2011 |
| DE | 10 2010 051 539 | 5/2012 |
| GB | 986538 | 3/1965 |
| WO | WO2010/034375 | 4/2010 |
| WO | WO2011/054528 | 5/2011 |

* cited by examiner

DEVICE FOR PROCESSING CONTAINERS

RELATED APPLICATIONS

This application is the national stage entry under 35 USC 371 of PCT application PCT/EP2012/003841, filed Sep. 13, 2012 which claims the benefit of the Nov. 23, 2011 priority date of German application 10 2011 119 171.6, the contents of which are herein incorporated by reference.

FIELD OF INVENTION

The invention concerns a device for processing containers, in particular for printing on containers.

BACKGROUND

Devices for processing containers by printing thereon are known, for example as described in DE 10 2006 001 223.

Also known are devices in which the containers are moved on a processing section formed by a plurality of rotors connected to each other for transport of containers, with the rotors being driven to rotate around a vertical machine axis. At processing positions of each rotor, a processing stage of a process having a plurality of processing steps takes place. Examples include application of a color set for color printing, the pre-processing of the containers for printing or hardening and/or cross-linking of the printing ink, e.g. by the input of energy, i.e. by heat and/or UV radiation and/or microwave radiation and/or beta radiation. It is also known, in connection with printing on containers, to use liquid or largely liquid printing colors or printing inks that are ejected by electronically controlled inkjet print heads or their nozzles.

It is also known, as described in DE 10 2009 043 497 A1, to suspend containers from container carriers or pucks during processing, each of which is moved through the entire processing section with the container held on it.

DE 10 2009 013 477 A1 describes an extractor device in which each individual container is held in an extractor bushing provided with an opening unit.

During the processing, and in particular, during the printing of the containers, it is quite difficult to prevent foreign or harmful substances or contaminants from being released into the environment. Examples of such contaminants include printing ink sprayed or released during printing, solvent that evaporates as a result of input of energy during the drying of the printing ink, ozone arising during drying of printing ink with UV light, and spilled solvents. With processing or printing devices working at a high output, with which for example up to 36,000 multi-color printed images are produced per hour, these contaminants lead to unhealthy pollution of the environment, and to an uncontrolled contamination of machine or device elements if no extractor device is provided for the foreign matter or contaminants.

SUMMARY

The invention provides a device for the processing, in particular for the printing, of containers with an extractor device that, with a high level of operational reliability and with a reduced structural and energy input, allows effective extraction of foreign substances or contaminants arising during the processing. With a device according to the invention, the extraction of the foreign substances or contaminants takes place directly at the processing positions, i.e. directly at the place at which the foreign substances or contaminants arise.

The invention relies on the use of an extractor hood that is open to the rotor and that does not rotate with the rotor. The extractor hood extends in the direction of rotation of the rotor at least over the angular range of the rotational movement of the rotor or of the rotor circumference corresponding to a processing section. Air turbulence arising due to the rotation of the rotor and also by a possible rotation or rotary movement of the containers during their processing has basically no or substantially no negative influence on the extraction of the foreign substances or contaminants. Instead, the rotational movement of the rotor is used for an accelerated removal of the foreign substances and contaminants from the processing positions due to the centrifugal forces and for acceleration of the spent air current. As a result, the rotational movement supports the extraction of the foreign substances or contaminants.

The particular extractor hood is optimally aerodynamically formed in its interior hood space in relation to the flow conditions there. This improves energy and process efficiency. In particular, the hood is configured such that airflow acting positively on the processing or printing process is achieved with minimally injected extraction energy at the processing positions. As a result, the extractor device can be operated cost-effectively.

In one aspect, the invention features an apparatus for processing containers. Such an apparatus includes an extractor unit for placement adjacent to a rotor that has a plurality of processing positions disposed in a circumferential area thereof, the rotor being configured for rotation in a rotation direction around a rotor axis thereof. The extractor unit extracts contaminants arising during processing of the containers. It comprises an extractor hood, an extractor channel, baffles, flow channels, and a joint suction channel. The hood forms a hood interior that, in operation, does not move with the rotor. It extends over at least a part of the circumferential area. The hood interior opens radially to the rotor and is connected by the an extractor channel to a suction device. The baffles are formed by wall elements in the hood interior. These baffles define the flow channels that are open on a side of the extractor hood that is turned towards the rotor, and that open inside the extractor hood into the joint suction channel, which serves plural flow channels.

In some embodiments, the baffles extend between a lower housing wall and an upper housing wall that is offset relative to the lower housing wall in a direction of the rotor axis.

Other embodiments include a filter device that connects the hood interior to at least one of the extractor channel and an extractor pipe.

Embodiments include those in which the extractor channel is connected to the hood interior and those in which the extractor channel is connected to the hood interior at a rear end thereof relative to the rotation direction.

Also included are embodiments in which the extractor hood encompasses an axial height of the processing stations and embodiments in which the circumferential area extends into the hood interior.

In some embodiments, the extractor hood is separated from a periphery of the rotor by a distance that decreases along a direction of rotation of the rotor.

Also among the embodiments are those in which the extractor unit is movable between a first position adjacent to the rotor and a second position at a distance from the rotor. These include embodiments in which the extractor hood is mounted on the extractor channel and other embodiments in which the extractor hood is rotatable around an axis of rotation and the extractor channel forms an integral part of the axis of rotation.

Also included are embodiments that have several rotors, each of which is drivable to revolve around a corresponding rotor axis thereof. These rotors are coupled to each other to enable transportation of containers from one rotor to another. The rotors, which collectively form a container processing section, include one or more rotors from which contaminants are released during processing. In this embodiment, the extraction unit is allocated to these one or more rotors.

In some embodiments the positions comprise at least one processing position for printing on the containers.

As used herein, the term "containers" includes cans, bottles, tubes, pouches, in each case made of metal, glass and/or plastic, and other packaging means that are suitable for filling with products.

As used herein, the expression "substantially" or "approximately" means deviations from exact values in each case by +/−10%, and preferably by +/−5%, and/or deviations in the form of changes not significant for functioning.

Further developments, benefits and application possibilities of the invention arise also from the following description of examples of embodiments and from the figures. In this regard, all characteristics described and/or illustrated individually or in any combination are categorically the subject of the invention, regardless of their inclusion in the claims or reference to them. The content of the claims is also an integral part of the description.

BRIEF DESCRIPTION OF THE DRAWINGS

The invention is explained in more detail below by means of the figures using an example of an embodiment, in which.

DETAILED DESCRIPTION

Figure 1:
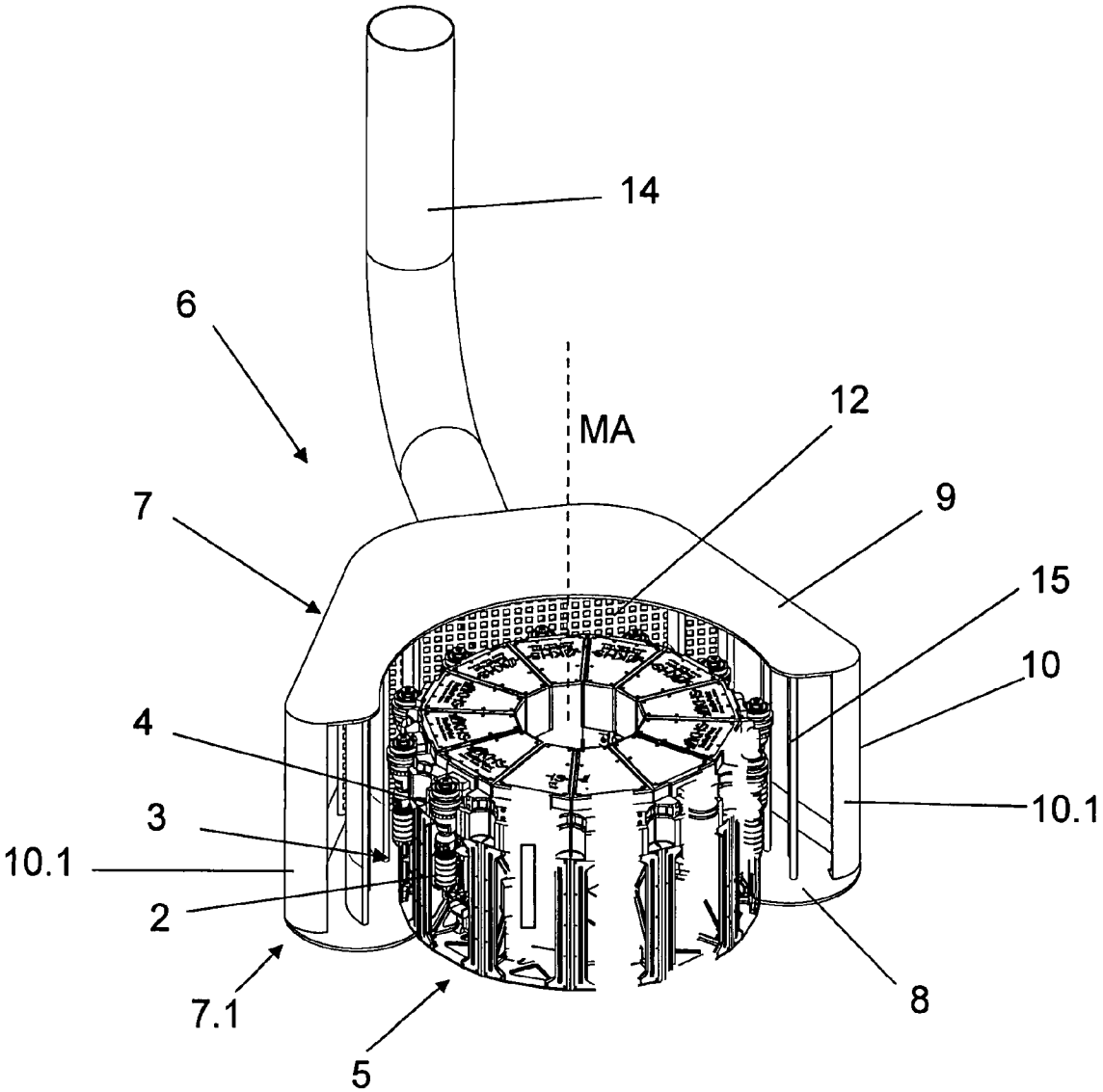
FIG. 1 is a simplified perspective representation of the rotor of a device for the processing of containers by printing, together with an extractor device.
Figure 2:
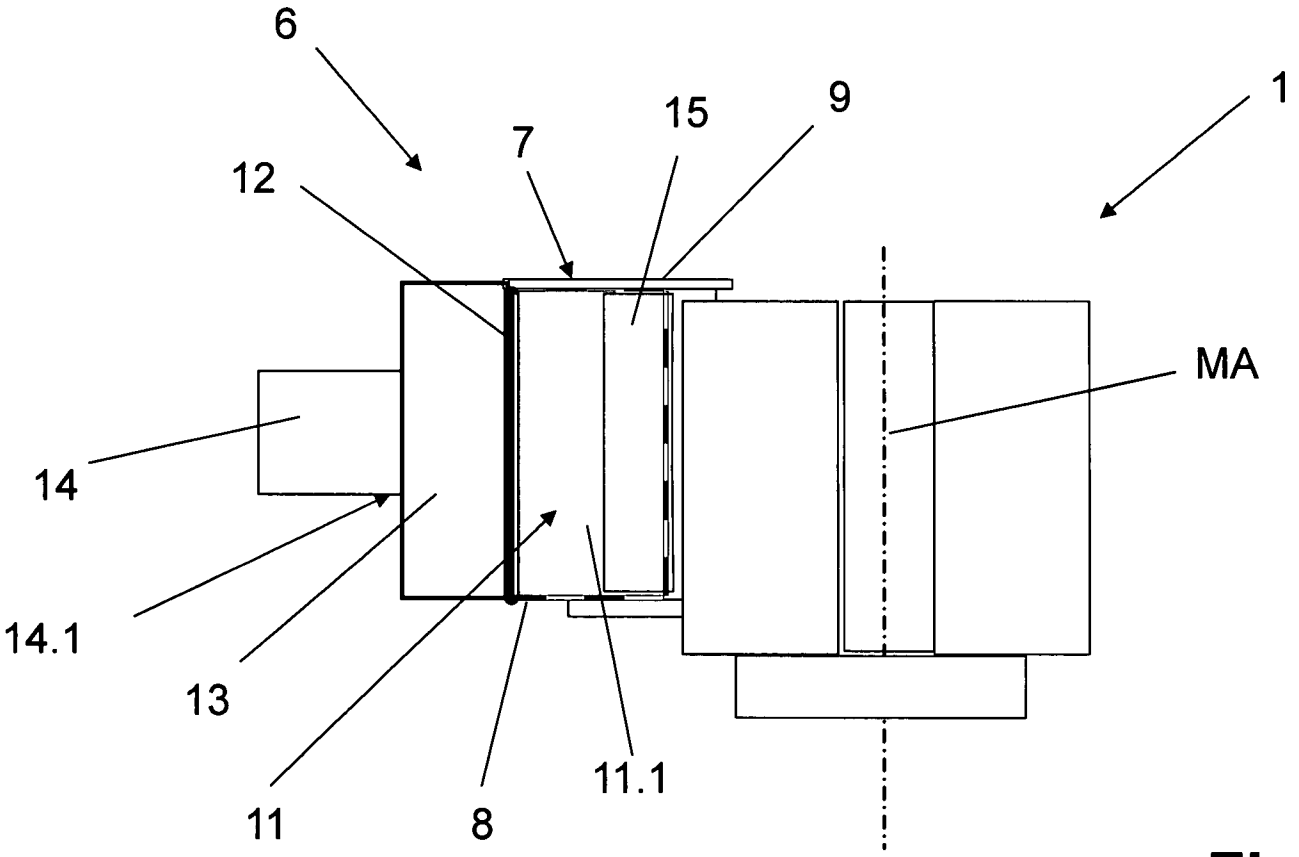
FIG. 2 is a simplified schematic cross-sectional representation of the rotor and the extractor device of FIG. 1 or its extractor hood in a vertical sectional plane including the rotor axis.
Figure 3:
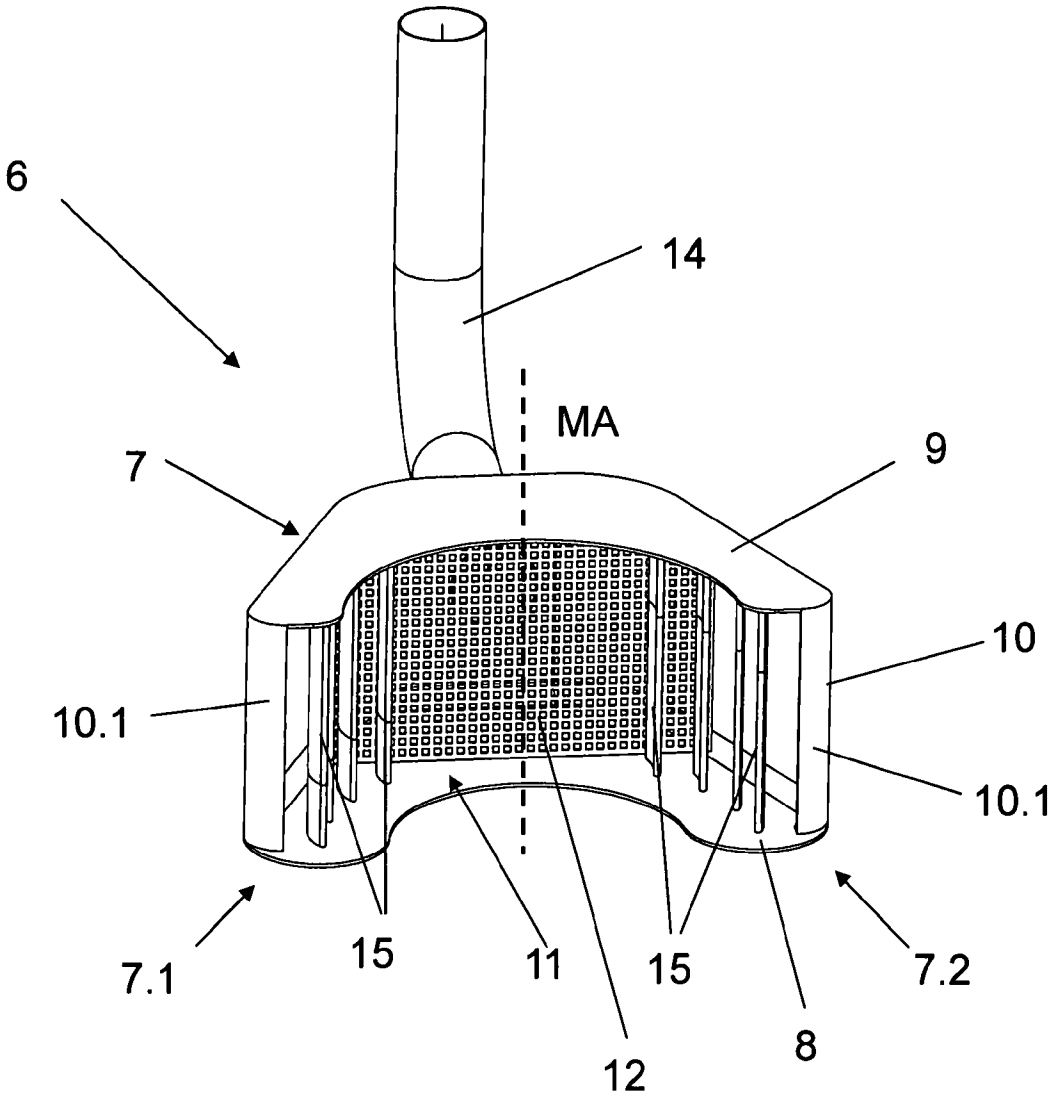
FIG. 3 is a perspective individual illustration of the extractor device.

FIG. 1 shows a rotor 1 that can be driven to rotate around a vertical machine axis MA. The rotor 1 is a module of a processing machine or device for printing on containers 2, for example for the direct printing of containers 2 on their outer or jacket surface with multi-colored printed material. In some cases, the processing device, the details of which are not shown, has a plurality of rotors or modules that are connected to each other for transport of containers in the container transport direction. At processing positions 3, a partial processing is carried out. Examples of partial processing include application of a color set of the multicolor print, preparation of the container surface for the print, the drying of the printing ink, etc.

The processing positions 3 are formed on the circumference of the rotor 1. The processing positions 3 are distributed at regular angular distances around the machine axis MA and at the same radial distance from the machine axis MA. Containers 2 are suspended from container carriers 4 at the processing positions 3 with their container axes in a vertical direction oriented parallel to the machine axis MA. In the illustrated embodiment, the container carriers 4 comprise pucks that are moved through the device with the containers 2 and that, during container processing, allow a controlled rotary or swivel movement of the containers 2 around their container axes.

A processing head 5 is provided at the processing positions 3 of the rotor 1. The processing head 5 is used to carry out the particular processing step, for example the application of a color set of the multicolor printing. In this case, the processing heads 5 are print heads, and moreover especially electrically controllable inkjet print heads that apply liquid, i.e. ink pigments in a printing color or printing ink containing a liquid matrix (solvent), using nozzles in a controlled manner onto a container at the processing position 3.

If the processing positions 3 on the rotor 1 are those for drying the printing ink by radiation of energy from, for example, a heat source, a UV light etc., then the processing heads 5 at these processing positions 3 release the corresponding energy radiation.

During printing, some printing ink can be sprayed or splashed. This ink does not reach the containers 2. Additionally, solvent residues can be released during the drying of the printing ink. When UV radiation is used, ozone is generated.

An extractor device 6 prevents these and other contaminants from entering the environment. The extractor device, which does not rotate with the rotor 1, includes an extractor hood 7 that encloses a portion of the circumference of the rotor 1. The enclosed portion is defined by that portion of the angular range of the rotary movement of the rotor 1 on which the processing of the containers 2 takes place at the processing positions 3. This angular range can be, for example, between around 180° and 270°.

The extractor hood 7 or its housing extends up in the direction of the machine axis MA to a height that is at least equal to the corresponding height of the processing positions 3. In the illustrated embodiment, the height of the extractor hood 7 or its housing in the direction of the machine axis MA is greater than the height of the rotor 1 so that the extractor hood 7 extends from the underside of the rotor 1 through to over its top side.

In more detail, the housing of the extractor hood 7 consists of a lower housing wall 8, an upper housing wall 9, and a circumferential wall 10.

In the illustrated embodiment, the upper and lower housing walls 8, 9 are arranged with their surfaces on planes that are perpendicular or substantially perpendicular to the machine axis MA.

The outer circumferential wall 10 is distanced from and partially encloses the machine axis MA and the rotor 1. The circumferential wall 10 ends at first and second circumferential wall sections 10.1, 10.2 that extend in the direction A of rotation of the rotor 1 at a leading end 7.1 of the extractor hood 7 and at a trailing end 7.2 of the extractor hood 7. The extractor hood 7 does not rotate with the rotor 1 and encloses the rotor 1 over part of its circumference, thus forming an open hood interior 11 extending radially from the rotor 1.

In the middle, or approximately in the middle, between the leading and trailing ends 7.1 and 7.2, a large filter arrangement 12 in the form of at least one air filter is provided at the rear wall formed by the circumferential wall 10 in the hood interior 11.

The filter arrangement 12 extends over an angular range that is substantially larger than half the perimeter of the extractor hood 7 between the leading and trailing ends 7.1, 7.2, and extends from the inner surface of the lower housing wall 8 through to the inner surface of the upper housing wall 9 and separates the hood interior 11 from a chamber 13 that is provided on the rear side of the extractor hood 7 turned away from the rotor 1.

The chamber 13, which is closed to the environment, is connected at an intake channel connection 14.1 to an extractor channel 14 that has a relatively large cross-section and that is formed, for example, from a pipe and/or from a tube system connected to a negative pressure or suction source, the details of which need not be illustrated. A suitable negative pressure source is, for example, a suction or negative pressure inlet of a suction fan.

During the processing of the containers 2 at the rotor 1 driven around the machine axis MA, the foreign substances or contaminants arising during the processing, or the spent air containing them, are extracted from the circumference of the rotor 1 or from the processing positions 3 there, i.e. directly at the place they arise. The foreign substances or contaminants in the spent air are at least partially filtered out right at the filter device 12. To optimize extraction, the rotor 1 in the illustrated embodiment extends, by its circumferential area containing the processing positions 3, into the hood interior 11. Lamella-type wall elements 15 acting as baffles are provided in the hood interior 11, this being also in the area of the leading and trailing ends 7.1, 7.2 and between these ends.

In the illustrated embodiment, these lamella-type wall elements 15, which are spaced both from the circumference of the rotor 1 to form a suction channel 11.1 and from the internal side of the circumferential wall 10, extend in each case from the lower housing wall 8 to the upper housing wall 9 and are oriented or slanted such that, at those wall elements 15 that are provided in the direction A of rotation of the rotor 1 before the intake channel connection 14.1 or on a first partial length (e.g. half) of the extractor hood 7, the distance between the circumference of the rotor 1 and the particular wall element 15 increases in the direction of rotation of the rotor A, and such that at those wall elements 15 that are provided in the direction of rotation of the rotor A after the extractor channel connection 14.1 or on a second partial length (e.g. half) of the extractor hood 7, the space between the circumference of the rotor 1 and the particular wall element 15 decreases in the direction of rotation of the rotor A.

The wall elements 15 contribute to an optimal distribution of the extraction performance and to the achievement of optimal flow conditions by, for example, avoiding turbulence. Moreover, for the extractor device 6, a particularly effective extraction effect at a reduced output of the extractor fan connected to the extraction channel 14 occurs because the foreign substances or contaminants arising during the processing of the containers 2 are delivered into the hood interior 1, which opens radially to the rotor, simply as a result of centrifugal forces that naturally arise from the rotation of the rotor 1.

Figure 4:
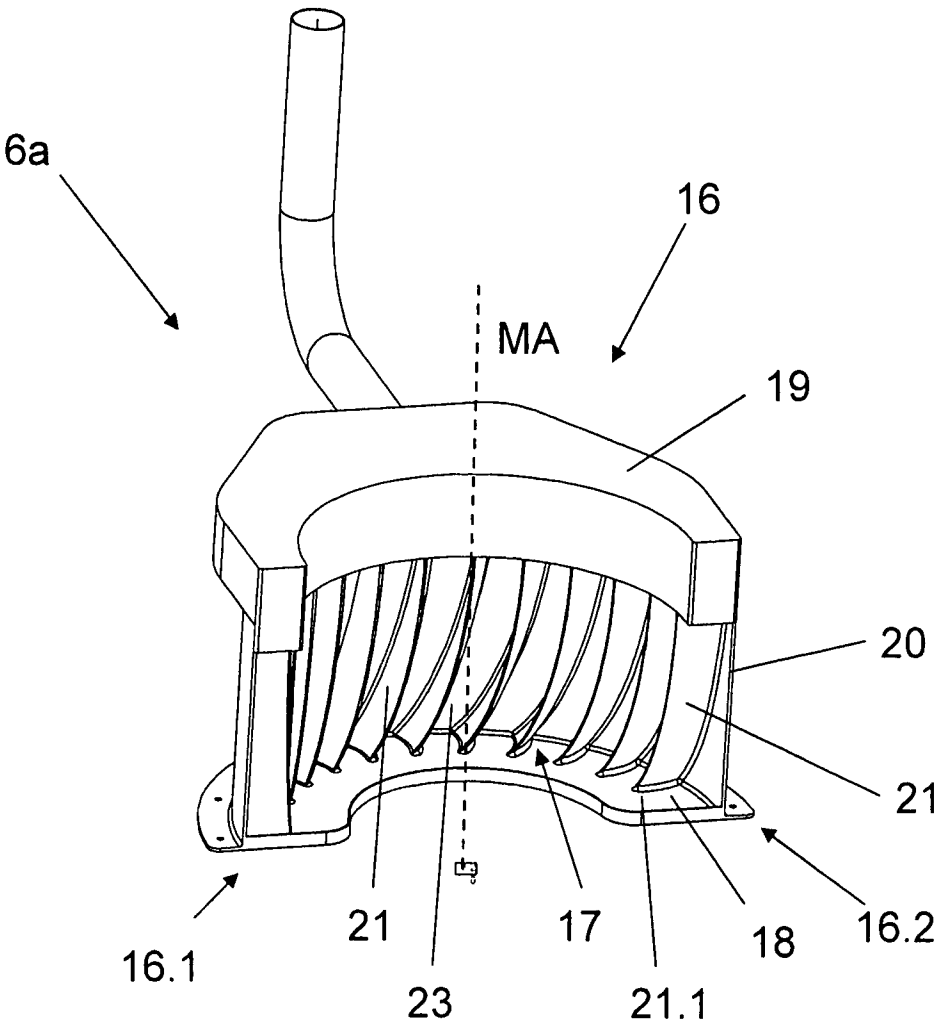
FIG. 4 is a representation similar to FIG. 3 in a further embodiment.
Figure 5:
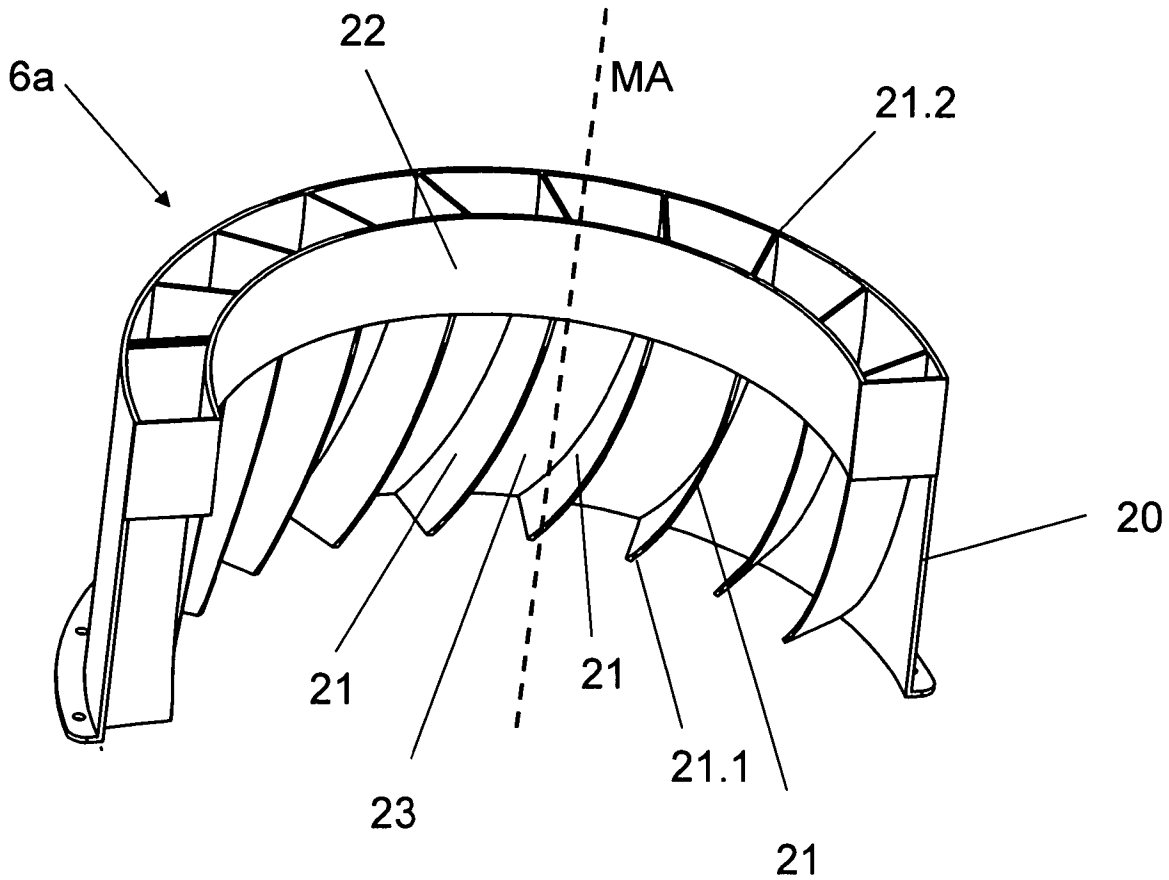
FIG. 5 is a perspective individual illustration of the fin or baffle arrangement of the extractor device of FIG. 4.
Figure 7:
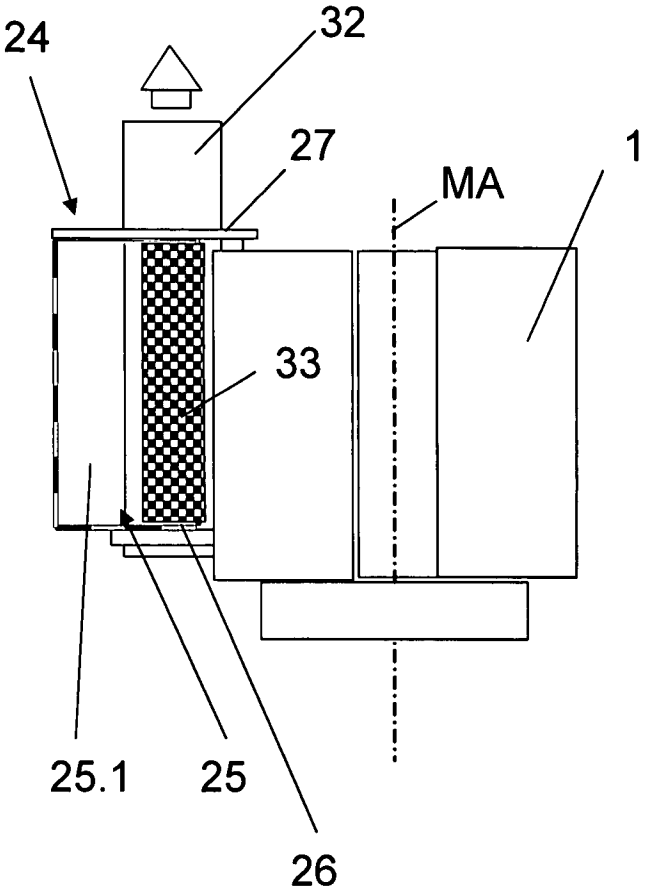
FIG. 7 is a simplified schematic cross-sectional representation of the rotor and the extractor device of FIG. 6 or its extractor hood in a vertical sectional plane including the rotor axis.

FIGS. 4 and 5 show, as a further embodiment, an alternative extractor device **6*a* that can be used instead of the extractor device 6. The alternative extractor device 6*a* again has an extractor hood 16 corresponding to the extractor hood 7. The hood interior 17 of the extractor hood 7 is connected by a filter device to the extractor channel 14 and by the extractor channel 14 to the extractor fan, which is not illustrated. The extractor hood 16 extends over part of the circumference of the rotor 1 in the direction A of rotation of the rotor 1, relative to the machine axis MA over an angular range smaller than 360°, for example over an angular range of around 180° to 270°. The hood interior 17 is bounded on its underside by an arc-shaped base wall 18, on its top side by a chamber 19, and on its circumference by a circumferential wall 20. In the illustrated embodiment, the circumferential wall 20 is an arc that encloses and is spaced from the machine axis MA. The rotor 1 is not illustrated in FIGS. 4 and 5. In these figures, however, the illustrated machine axis MA is also the axis of the rotor 1**.

A plurality of lamella-type wall elements 21 act as baffles. These lamella-type wall elements 21 are provided inside the hood interior 17. Each one extends from the lower housing wall 18 and into the chamber 19. The chamber 19 is open on a side turned towards the housing underside 18, and is otherwise closed to the environment. The chamber 19 extends over the entire angular length of the extractor hood 16 between a leading end 16.1 and a trailing end 16.2.

The wall elements 21 are oriented with their lower ends 21.1 fixed on the lower housing wall 18 and with their upper ends 21.2 extending into the chamber radially or substantially radially in relation to the machine axis MA. The upper end 21.2 of a wall element 21 is offset by an angle value relative to the lower end 21.1 of that wall element 21 in the direction A of rotation of the rotor 1. In the illustrated embodiment, the value of this angle approximately corresponds to the spacing between two adjacent wall elements 21 or is slightly smaller than this spacing. Moreover, the front sides of the wall elements 21 define a dome that is concave relative to the direction A of rotation of the rotor 1.

In the area of their upper end 21.2, the wall elements 21 are attached to an additional wall element 22 that is already part of the wall of the chamber 19. The actual interior of the chamber 19, in which the flow paths 23 formed between the wall elements 21 open and which forms a suction channel corresponding to the suction channel 11.1, is located above the additional wall element 22. Inside the chamber 19, for example a filter device corresponding to the filter device 12 is provided.

During the processing of the containers 2, as the rotor 1 rotates, the spent air, which carries foreign substances or contaminants, is extracted from the area around the processing positions 3 through flow channels 23 that are formed between two wall sections 21, the chamber 19 and the extractor channel 14. A filter device corresponding to the filter device 12 is provided in the chamber 19. As a result, foreign substances or contaminants in the spent air will be at least partially removed in the spent air before it is discharged into the environment.

FIGS. 6-9 show a further embodiment of an extractor device **6*b* with an extractor hood 24 corresponding to the extractor hood 7. The extractor hood 24 does not rotate with the rotor 1 and extends over a partial area of the rotor circumference, for example over an angular range of around 180° to 270°. The processing positions 3 are provided on the rotor circumference. The extractor hood 24, which is crescent-shaped when viewed from above, forms a hood interior 25 that opens radially relative to the rotor axis or relative to the machine axis MA and is therefore open to the circumference of the rotor 1. A lower housing wall 26, and upper housing wall 27, and a pitch-cylinder shaped circumferential wall 28 bound the extractor hood 24. In the illustrated embodiment, the pitch-cylinder shaped circumferential wall 28** is concentric with the machine axis MA.

Inside the hood interior 25 are wall elements 29 that act as baffles. These wall elements 29 extend from the lower housing wall 26 into the chamber 27 and reach through to the edge of the housing walls 26, 27 adjacent to the rotor 1. The wall elements 29 are spaced from the circumferential wall 28 to form a suction channel 25.1 that extends inside the hood interior 25 in the direction A of rotation of the rotor 1 from a leading end 24.1 relative to this direction of rotation through to a trailing end 24.2 of the extractor hood 24. Each wall element 29 is bent around an axis parallel to the machine axis MA, this being in such a way that the inner edge of each wall element 29 adjacent to the rotor 1 and extending between the housing walls 26 and 27 is offset relative to the corresponding outer edge lying at a distance to the rotor 1 by an angle value against the direction of rotation of the rotor A. This angle value corresponds, for example, to the spacing between two wall elements 29. Because the wall elements 29 are bent relative to the direction of rotation of the rotor convexly in each case on their front sides and concavely on their rear sides, they form between them flow channels 30 that open into the suction channel 25.1.

Figure 6:
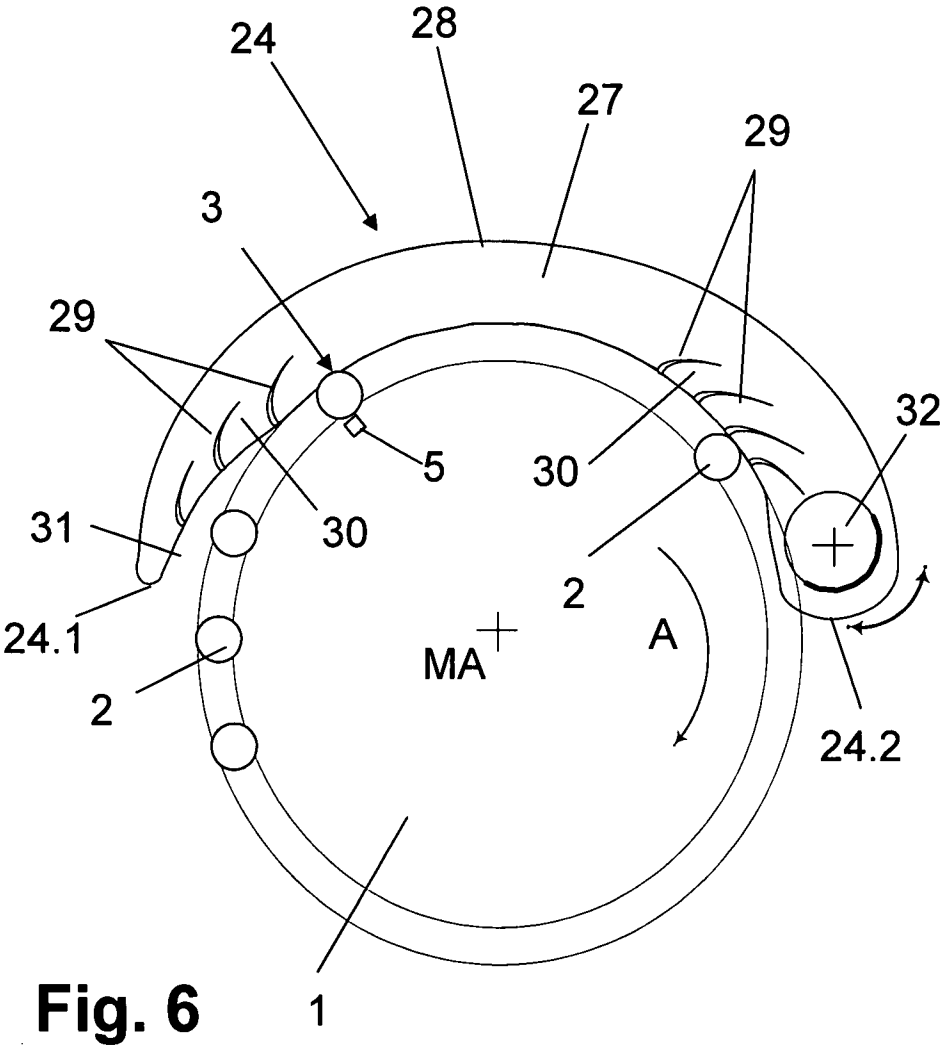
FIG. 6 is a simplified perspective representation a plan view of the rotor of a device for the processing of containers by printing, together with an extractor device according to a further embodiment of the invention.
Figure 8:
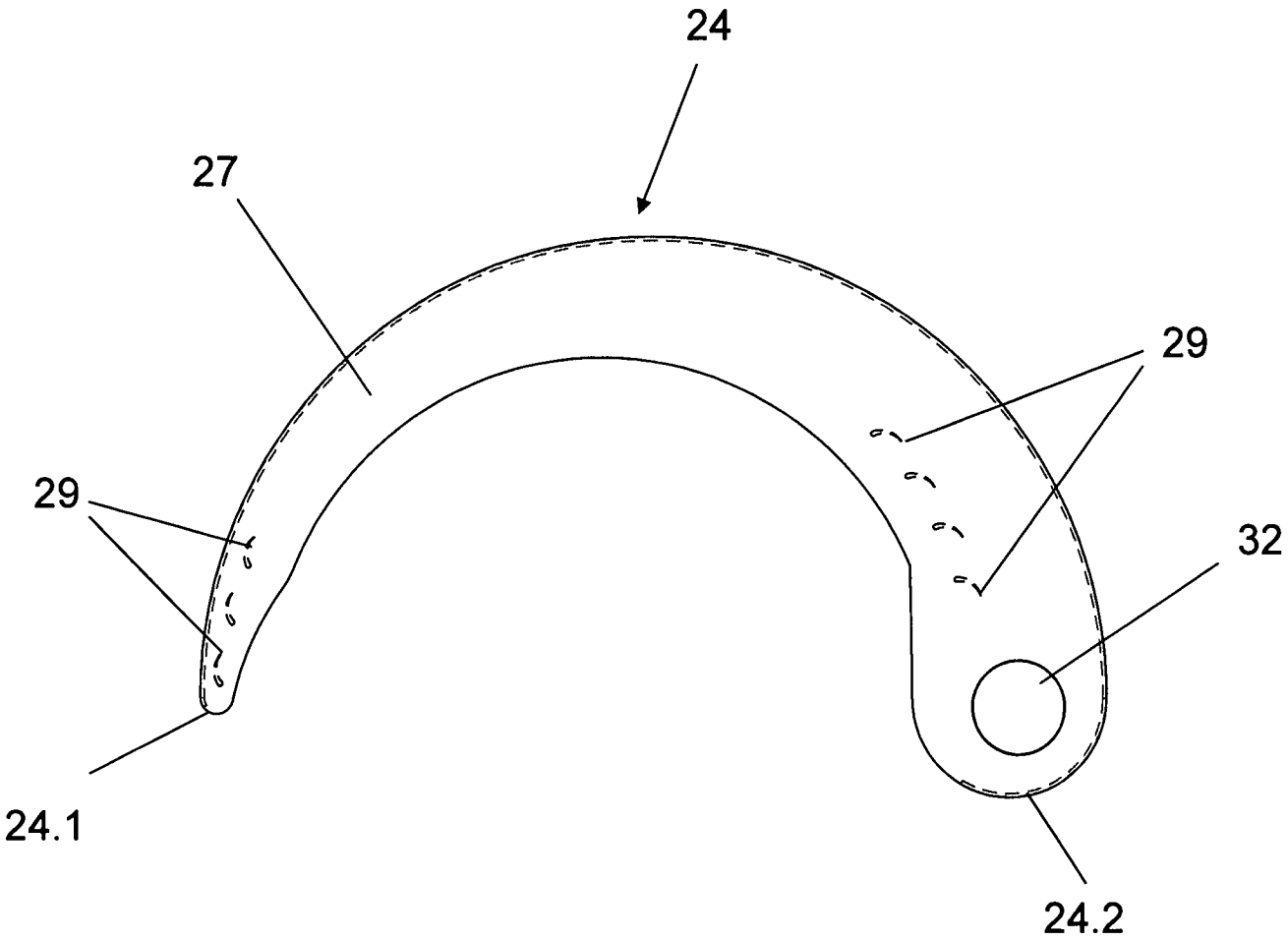
FIG. 8 shows the extractor hood of FIG. 6 in an individual representation and in plan view.
Figure 9:
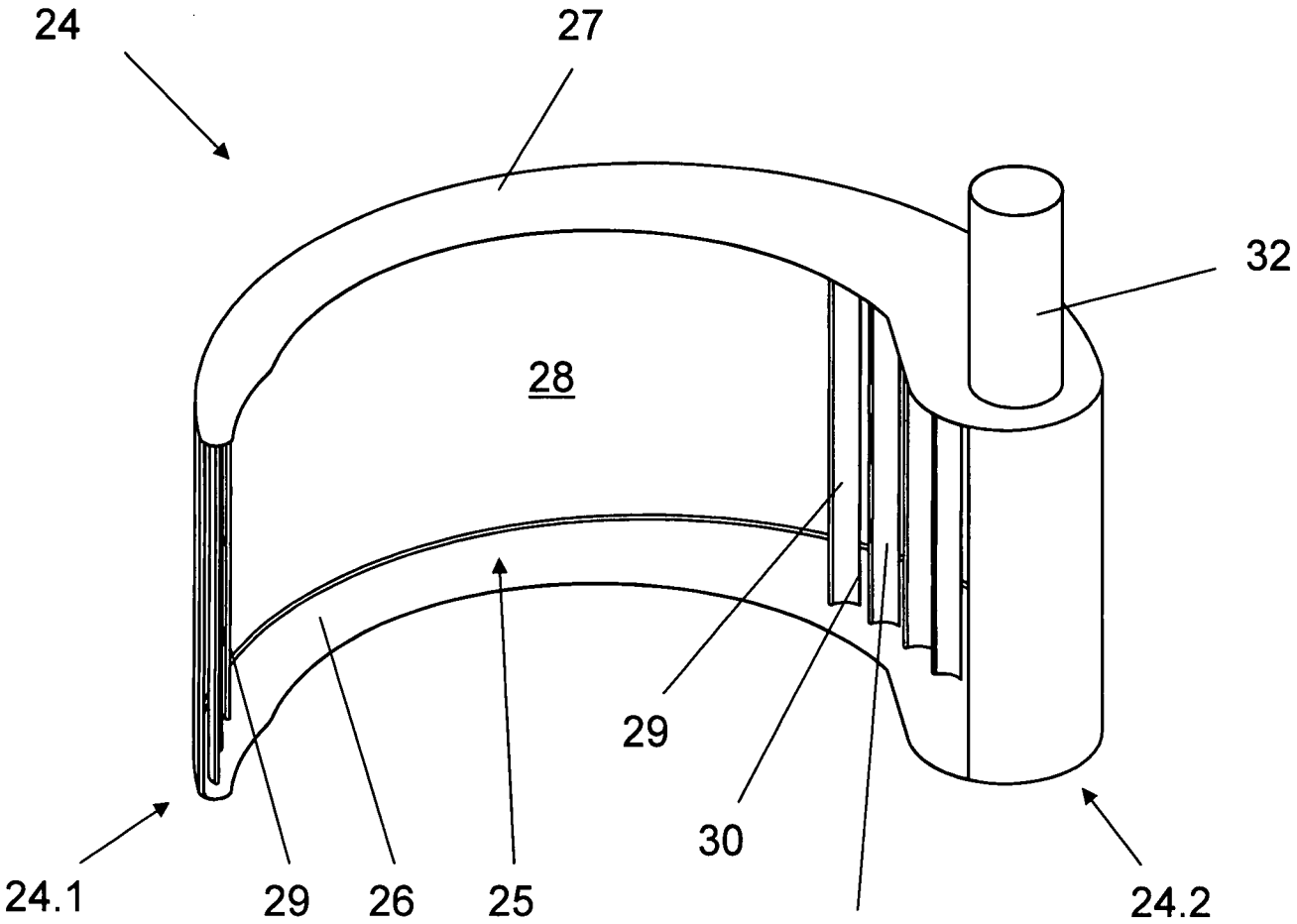
FIG. 9 shows the extractor hood of FIG. 6 in a perspective individual representation.

As FIG. 6 shows, the extractor hood 24, or its housing, is formed such that an inlet funnel 31 forms in the area of the leading end 24.1 between the extractor hood 24 and the circumference of the rotor 1. Over an extent that is smaller than the entire extent of the extractor hood 24, starting from the leading end 24.1, there is initially a larger space between the extractor hood 24 and the circumference of the rotor 1. This space decreases in the direction of rotation of the rotor A and does so continuously with no interrupting steps.

In the area of the trailing end 24.2, an extractor pipe 32 extends into the hood interior 25. The extractor pipe 32 is oriented with its axis parallel to the machine axis MA and connects to the extractor channel 14, not illustrated. The extractor pipe 32 closed at its end adjacent to the housing wall 26 and has a sieve 33 formed in a portion thereof by a multiplicity of openings on its jacket surface. The sieve 33 enables connection between the suction channel 25.1 and the inside of the suction pipe 32.

In the illustrated embodiment, the extractor hood 24 can be swiveled around an axis parallel to the machine axis MA. This axis is, for example, the axis of the extractor pipe 32. The extractor hood 24 can thus be swiveled away from the rotor 1 out of the work position illustrated in FIG. 6 for cleaning, maintenance and repair.

It is also, in principle, possible to provide a filter device like filter device 12 at the transition between the section channel 25.1 and the extractor pipe 32. Such a filter device could be place, for example, on the sieve 33.

The extractor device **6*b* corresponds to a particularly preferred embodiment of the invention, in which the connection for the extractor channel 14 or the suction pipe 32 on the trailing end 24.2 is located. Due to the structure, with its mix of radially projecting and recessed areas, the processing positions 3 and their functional elements, when the rotor 1 rotates, a current of air is generated inside the extractor hood 24 through the current channels 30 and the suction channel 25.1 and into the extractor pipe 32. This current of air, which arises from motion that would have to occur anyway, supports a rapid and complete removal or extraction of all foreign substances or contaminants, and does so with greatly reduced energy consumption by a suction fan connected to the suction pipe 32**.

As can be seen in FIG. 5, the circumferential wall 20, together with the wall elements 21 and the additional wall element 22, forms a module that is fixed on a plate that forms the lower housing wall or on the top side of a table of the container processing machine that forms the lower housing wall 18, and if necessary, for example for cleaning and/or repair purposes, can be taken off the lower housing wall 18 and/or replaced.

The invention has been described above using examples of embodiments. It is clear that numerous modifications and variations are possible without thereby departing from the inventive idea underlying the invention. Common to all embodiments is that the fixed extractor hood, which does not rotate with the rotor 1, is provided laterally on the rotor and encloses it over part of its circumference in the direction of rotation of the rotor A. As a result, foreign substances or contaminants arising during the processing of the containers 2 are removed from the processing positions 3 directly at the place at which they arise. Moreover, the invention harnesses the rotational movement of the rotor 1 and uses it for accelerated removal of the foreign substances and contaminants from the processing positions 3 by using centrifugal forces to accelerate the current of spent air.

In the foregoing description, it has been assumed that the rotor 1 is part of a device or processing machine that has a plurality of rotors. Some of these rotors carry out processing steps that result in release of environmentally polluting foreign substances or contaminants. These rotors are fitted with an extractor device 6, **6*a* or 6*b*. According to the invention, however, the device or processing machine can also have just a single rotor 1 at which then the entire processing is carried out at the processing positions 3** concerned.

KEY TO REFERENCE NUMBERS

1 Rotor
2 Container
3 Processing positions
4 Container carrier or puck
5 Processing head
6, **6*a*, 6*b*** Extractor device
7 Extractor hood
7.1, 7.2 End of the extractor hood
8,9 Housing wall
10 Circumferential wall
10.1, 10.2 Circumferential wall section leading inwards
11 Hood interior
12 Filter device
13 Chamber
14 Extractor channel
14.1 Intake channel connection
15 Wall element or baffle
16 Extractor hood
17 Hood interior
18 Housing wall
19 Chamber
20 Circumferential wall
21 Wall element or air baffle
21.1, 21.2 Lower or upper end of the air baffle
22 Wall section
23 Flow channel
24 Extractor hood
25 Hood interior
25.1 Suction channel
26, 27 Housing wall
28 Circumferential wall
29 Air baffle or wall element
30 Flow channel
31 Inlet funnel

32 Extractor pipe
33 Sieve structure
A Direction of rotation of the rotor
MA Machine axis

The invention claimed is:

1. An apparatus comprising a container-processor configured for simultaneously holding and processing containers, wherein said container-processor includes an extractor unit for placement adjacent to a rotor that has a plurality of processing positions disposed in a circumferential area thereof, said rotor being configured for rotation in a rotation direction around a rotor axis thereof, wherein said extractor unit extracts contaminants arising during processing of said containers, wherein said extractor unit comprises an extractor hood, an extractor channel, baffles, flow channels, and a joint suction channel, wherein said extractor hood forms a hood interior, wherein said extractor hood, in operation, does not move with said rotor, wherein said extractor hood extends over at least a part of said circumferential area, wherein said hood interior is open radially to said rotor, wherein said hood interior is connected by said one extractor channel to a suction device, wherein said baffles are formed by wall elements in said hood interior, wherein said baffles define said flow channels, wherein said flow channels are open on a side of said extractor hood that is turned towards said rotor, wherein said flow channels open inside said extractor hood into said joint suction channel, and wherein said joint suction channel serves plural flow channels.

2. The apparatus of claim 1, wherein said baffles extend between a lower housing wall and an upper housing wall that is offset relative to said lower housing wall in a direction of said rotor axis.

3. The apparatus of claim 1, further comprising a filter device, wherein said filter device connects said hood interior to at least one of said extractor channel and an extractor pipe.

4. The apparatus of claim 1, wherein said extractor channel is connected to said hood interior.

5. The apparatus of claim 1, wherein said extractor channel is connected to said hood interior at a rear end thereof relative to said rotation direction.

6. The apparatus of claim 1, wherein said extractor hood encompasses an axial height of said processing stations.

7. The apparatus of claim 1, wherein said circumferential area extends into said hood interior.

8. The apparatus of claim 1, wherein said extractor hood is separated from a periphery of said rotor by a distance, wherein said distance decreases along said rotation direction.

9. The apparatus of claim 1, wherein said extractor unit is movable between a first position, in which said extractor unit is a first distance from said rotor and a second position, in which said extractor unit is a second distance from said rotor, wherein said second distance is greater than said first distance.

10. The apparatus of claim 1, wherein said extractor hood is mounted on said extractor channel.

11. The apparatus of claim 1, wherein said extractor hood is rotatable around an axis of rotation and said extractor channel forms an integral part of said axis of rotation.

12. The apparatus of claim 1, further comprising a plurality of rotors, each of which is drivable to revolve around a corresponding rotor axis thereof, wherein said rotors are coupled to each other to enable transportation of containers from one rotor to another, wherein said rotors form a container processing section, wherein said rotors comprise a first rotor from which contaminants are released during processing, wherein said extraction unit is allocated to said first rotor.

13. The apparatus of claim 1, wherein said processing positions comprise at least one processing position for printing on said containers.

14. The apparatus of claim 1, further comprising said rotor.

15. The apparatus of claim 1, wherein said baffles bend around an axis parallel to said rotor axis.

16. The apparatus of claim 1, wherein said each of said baffles comprises a first side and a second side, wherein said first side faces said rotation direction, wherein said second side faces away from said rotation direction, where said first side is concave, and wherein said second side is convex.

17. The apparatus of claim 1, wherein said hood is configured to be swiveled around an axis parallel to said rotor axis.

18. The apparatus of claim 1, wherein said hood comprises a leading end, wherein said hood comprises a trailing end, wherein said rotation direction defines a downstream direction, wherein said downstream direction defines an upstream direction that is opposite to said downstream direction, and wherein said trailing end of said extractor hood is downstream from said leading end of said extractor hood.

19. The apparatus of claim 18, wherein a distance between said hood and said rotor decreases continuously along said downstream direction.

20. The apparatus of claim 1, further comprising a sieve connected between said extractor channel and said joint suction channel.

* * * * *